US005979648A

United States Patent [19]

Focke et al.

[11] Patent Number: 5,979,648

[45] **Date of Patent: *Nov. 9, 1999**

[54] SOFT PACK FOR CIGARETTES

[75] Inventors: Heinz Focke, Verden; Hans- Jürgen Bretthauer, Bremen, both of Germany

[73] Assignee: Focke & Co., (GmbH & Co.), Verden, Germany

[ * ] Notice: This patent is subject to a terminal disclaimer.

[21] Appl. No.: 09/005,226

[22] Filed: Jan. 9, 1998

Related U.S. Application Data

[63] Continuation of application No. 08/772,867, Dec. 26, 1996, Pat. No. 5,762,186, which is a continuation of application No. 08/328,001, Oct. 24, 1994, abandoned.

[30] Foreign Application Priority Data

Oct. 25, 1993 [DE] Germany ..... 43 36 378

[51] Int. Cl.[6] ..... B65D 85/00

[52] U.S. Cl. ..... 206/273; 229/87.13

[58] Field of Search ..... 206/242, 245, 206/259, 271, 273; 229/87.13

[56] References Cited

U.S. PATENT DOCUMENTS

| | | | |
|---|---|---|---|
| 1,967,204 | 7/1934 | Genz | 206/245 |
| 2,214,172 | 9/1940 | Moore . | |
| 3,265,287 | 8/1966 | Hovland | 206/245 |
| 3,279,593 | 10/1966 | Cote . | |
| 3,301,468 | 1/1967 | Staley . | |
| 3,367,552 | 2/1968 | Kyanowski . | |
| 4,121,713 | 10/1978 | Focke et al. | 206/245 |
| 4,513,863 | 4/1985 | Schillinger | 206/273 |
| 5,762,186 | 6/1998 | Focke et al. | 206/245 |

FOREIGN PATENT DOCUMENTS

| | | |
|---|---|---|
| 857600 | 10/1952 | Germany . |
| 2712482 | 10/1978 | Germany . |
| 3027448 | 2/1982 | Germany . |
| 3124118 | 2/1983 | Germany . |
| 4235439 | 4/1993 | Germany . |
| 4206036 | 9/1993 | Germany . |
| 607542 | 2/1974 | U.S.S.R. . |

*Primary Examiner*—Jacob K. Ackun
*Attorney, Agent, or Firm*—Sughrue, Mion, Zinn, Macpeak & Seas, PLLC

[57] ABSTRACT

Soft packs for cigarettes, especially soft-cup packs, acquire an additional reinforcement in the region of a bottom wall (20) by means of a two-layer or multi-design layer design of a cup blank (21, 22) in the region of the bottom wall (20). The two-layer or multi-layer reinforcement of the cup blank (22) can also extend into the region of adjoining pack walls.

10 Claims, 6 Drawing Sheets

SOFT PACK FOR CIGARETTES

This is a Continuation of Application Ser. No. 08/772,867, filed Dec. 26, 1996, now U.S. Pat. No. 5,762,186 which is a Continuation of Ser. No. 08/328,001, filed Oct. 24, 1994, now abandoned.

BACKGROUND OF THE INVENTION

The invention relates to a soft pack for cigarettes, especially soft-cup pack, with a cup-shaped container, formed from a blank of foldable packaging material, for the reception of a cigarette group.

Soft packs for cigarettes are mainly known as soft-cup packs. In this type of pack, a cigarette group is wrapped completely in an inner blank consisting of tin foil or of paper. A cigarette block thus formed sits in the cup-shaped container open at the top. The latter conventionally consists of paper, but can also be formed from foil, multi-layer if appropriate.

A disadvantage of soft packs of this type, especially of soft-cup packs, is the lack of dimensional stability. Above all after some of the cigarettes have been extracted, the external shape of the soft-cup packs becomes unsightly, since the dimensionally stabilizing effect is no longer afforded by the pack content.

The object on which the invention is based is to design soft packs for cigarettes, especially soft-cup packs, in such a way that, whilst preserving the external appearance and functionality, they have increased dimensional stability.

To achieve this object, the soft pack or cup-shaped container according to the invention is characterized in that the blank is made multi-layer, especially two-layer, at least in the region of a bottom wall of the soft pack or of the cup-shaped container.

Accordingly, in the soft pack according to the invention, the packaging material itself is provided with a reinforcement increasing dimensional stability, as a result of a partially double-layer or multi-layer design of the blank. In an especially advantageous version, a blank of appropriate dimensions for the soft pack or for the cup-shaped container is two-layer or multi-layer in a part region as a result of folding. The blank thereby acquires a strip-shaped reinforcement which, during the production of the soft pack or container, brings about a local reinforcement of the pack. The reinforcement can also extend beyond the bottom wall in the region of adjoining pack walls.

According to a further proposal of the invention, the soft pack or cup-shaped container can be provided with reinforcements in a plurality of regions as a result of a double-layer or multi-layer design of the blank, especially in the region of the bottom wall on the one hand and in the region of an upper edge on the other hand.

According to the invention, during the production of the packaging material, the procedure is such that a continuous material web for the blanks is provided with a continuous reinforcing strip which is obtained particularly as a result of the folding round or Z-shaped folding of the material web. The blanks, together with the finished reinforcement, are separated from this material web.

Further particulars of the invention are explained in more detail below by means of exemplary embodiments illustrated in the drawings. In these:

DESCRIPTION OF PREFERRED EMBODIMENTS

Figure 1:
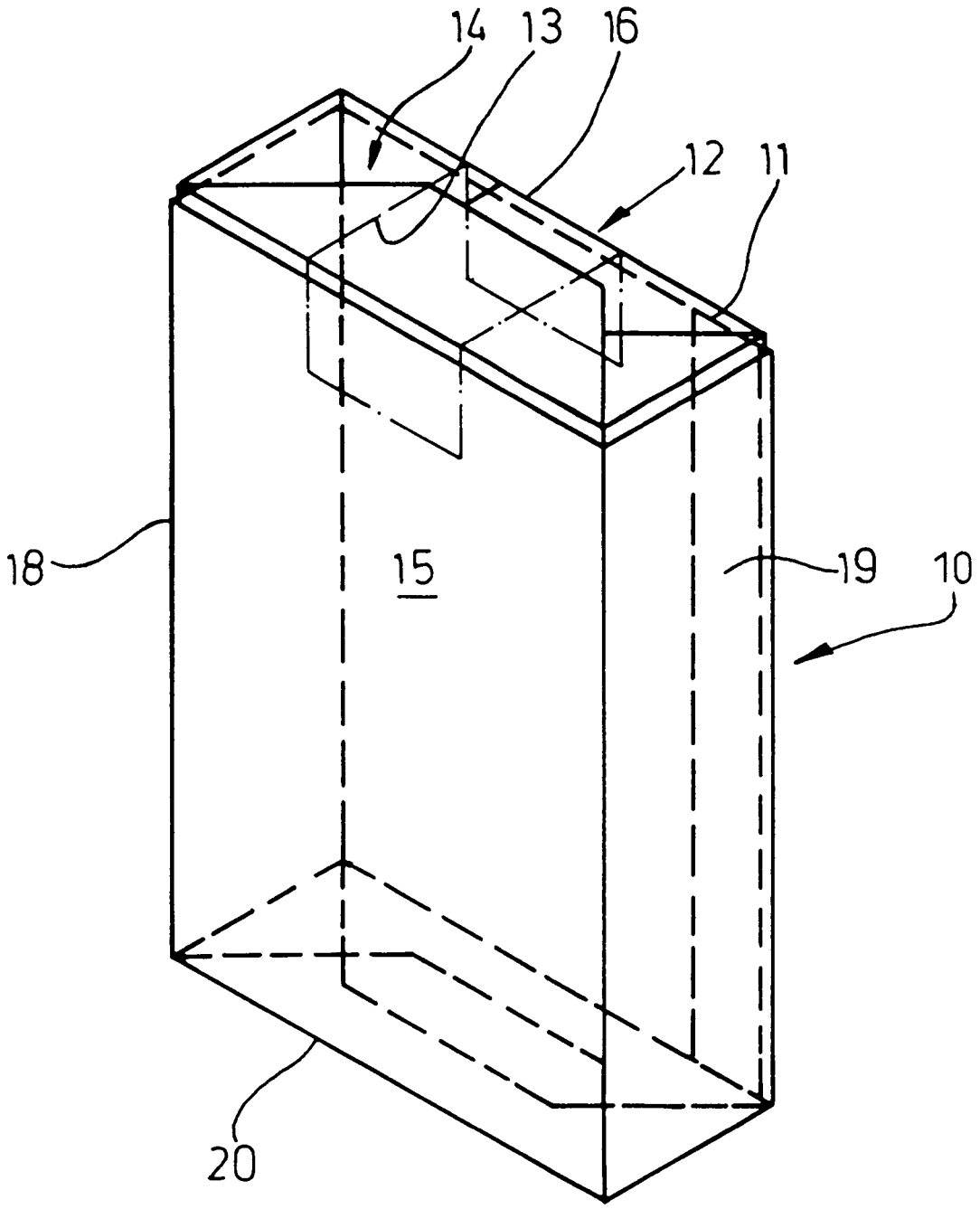
FIG. 1 shows a soft-cup pack for cigarettes in a perspective representation.

The exemplary embodiments of soft packs for cigarettes illustrated in the drawings relate to two types having a differing basic construction. The embodiments according to FIG. 1 to FIG. 9 are typical soft-cup packs consisting of a plurality of or two blanks. FIG. 11 to FIG. 14 show particulars of a soft pack consisting of only one blank of packaging material.

A typical soft-cup pack consists of an outer cup-shaped container 10 and of a cigarette group 31, wrapped in an inner blank 11, for forming a cuboid cigarette block 12 as the pack content. The cigarette block 12 projects out of the container 10 slightly at the top, that is to say on the open side. A band 13 is conventionally attached in this region and extends transversely over an end wall 14 of the cigarette block 12 into the region of an adjoining front wall 15 and rear wall 16 of the container 10.

The inner blank 11 completely surrounds the cigarette group 31. The inner blank 11 is designed so that the end wall 14 of the cigarette block 12 is formed from folding tabs, specifically as an envelope fold. The inner blank 11 consists of paper or tin foil.

The cup-shaped container 10 consists of a one-piece cup blank. This defines the large-area front wall and the corresponding rear wall 16, narrow vertical side walls 18, 19 and a bottom wall 20 formed by folding.

To increase the dimensional stability of a soft-cup pack of this type, material reinforcements are provided in the region of the bottom wall 20. In the exemplary embodiments shown, these consist directly of parts of a cup blank 21, 22. A part of the cup blanks 21, 22 which forms the bottom wall 20 and, if appropriate, adjoining regions is made two-layer or multi-layer, thereby affording the increased rigidity of the material.

Figure 2:
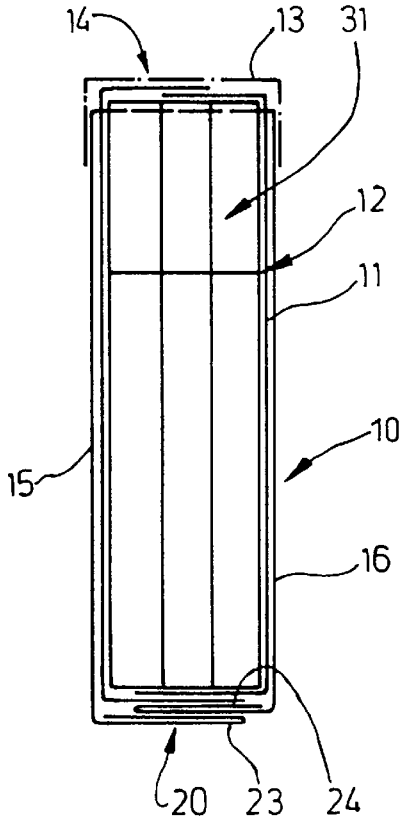
FIG. 2 shows a vertical section through the soft-cup pack according to FIG. 1.
Figure 3:
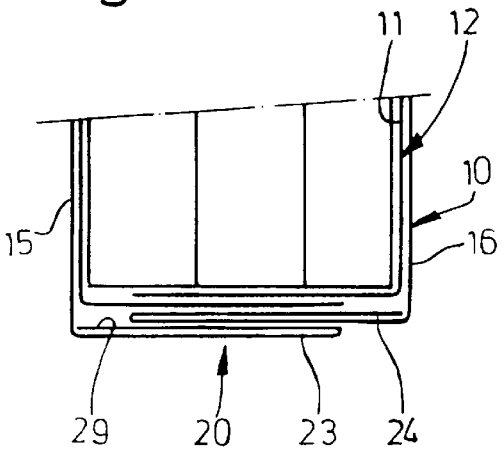
FIG. 3 shows the lower bottom region of the soft-cup pack in vertical section, on an enlarged scale.

In the exemplary embodiment according to FIG. 2 and FIG. 3 of the packs, a material reinforcement is provided only in the region of the bottom wall 20 itself. All the folding tabs forming the bottom wall 20, namely trapezoidal longitudinal tabs 23 and 24 partially overlapping one another and corner tabs 25, 26 adjoining the narrow side walls 18, 19, consist of two layers or two walls of the cup blank 21, particularly of (thicker) paper. The bottom wall 20 thereby has a clearly higher rigidity than in a single-layer design.

Figure 4:
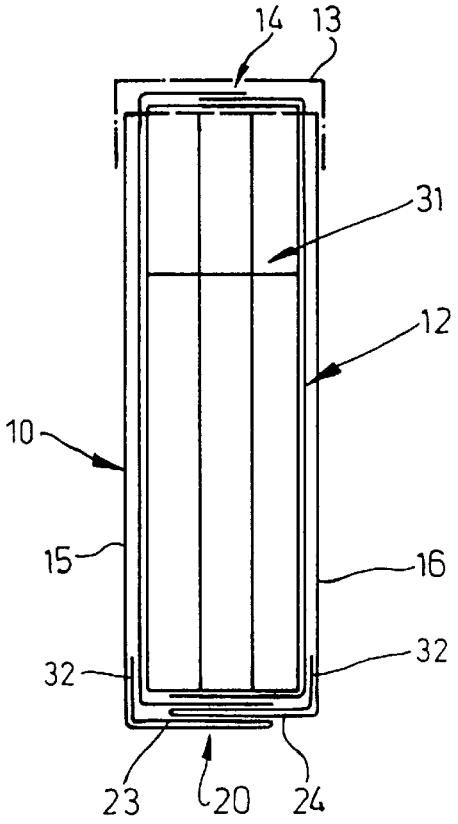
FIG. 4 shows a representation, corresponding to that of FIG. 2, of another embodiment of a soft-cup pack.
Figure 5:
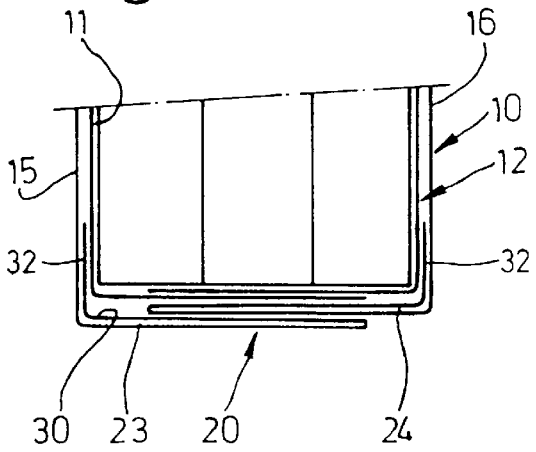
FIG. 5 shows a representation corresponding to that of FIG. 3 and relating to the exemplary embodiment of FIG. 4.

In the exemplary embodiment according to FIG. 4 and FIG. 5, a further increase in dimensional stability in the region of the bottom wall 20 is afforded by a double-layer design of the cup blank 22 also in the (lower) region of the front wall 15, rear wall 16 and side walls 18 and 19. Here, therefore, the reinforcement of the container 10 is made three-dimensional.

The cup-shaped containers 10 are produced from rectangular cup blanks 21, 22 (FIGS. 6–9) which can be separated from a continuous material web 27, 28. A longitudinally extending edge strip 29, 30 of the material web 27, 28 serves for producing the bottom wall 20 of the separated cup blanks 21, 22. The material reinforcement is already produced on the material web 27, 28. For this purpose, the latter has a larger initial width than that of the cup blanks 21, 22. The edge strip 29, 30 extending in the longitudinal direction of the material web 27, 28 is folded round until it comes to rest on the inside of the material web. The cup blank 21, 22 separated from the material web 27, 28 thus designed is prepared directly for the folding process.

The material reinforcement, namely the edge strip 29, 30, can be connected to the remaining part of the cup blank 21, 22 by adhesive bonding taking place preferably over the entire area. This results in additional rigidity. In the case of multi-layer foils for the production of the cup-shaped container 10, the edge strip 29, 30 can also be fixed by means of the heat sealing of a plastic layer.

Figure 7:
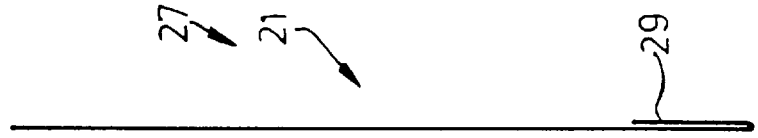
FIG. 7 shows a cross-section through the material web of FIG. 6.
Figure 6:
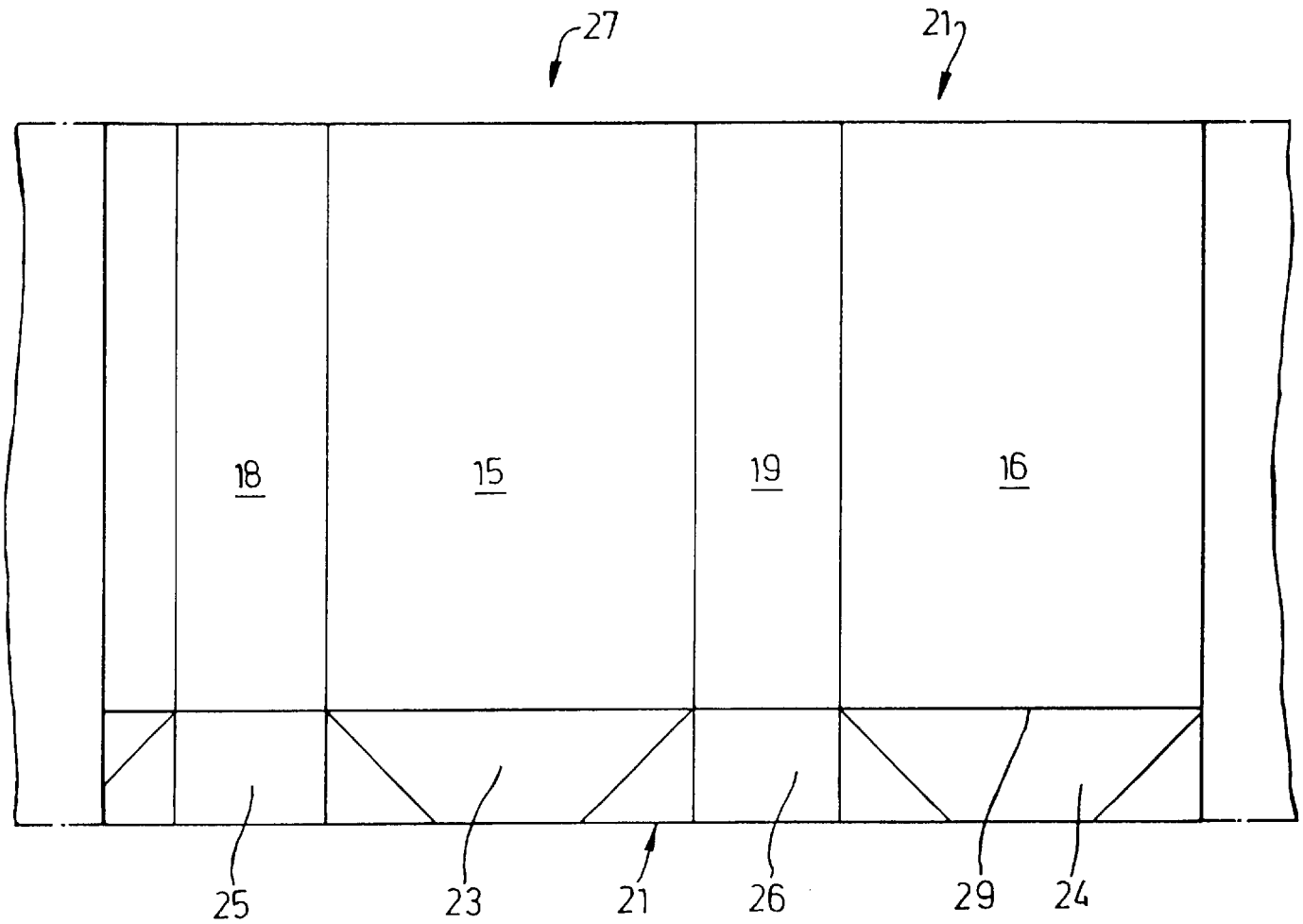
FIG. 6 shows a continuous material web for the exemplary embodiment according to FIGS. 2 and 3.
Figure 9:
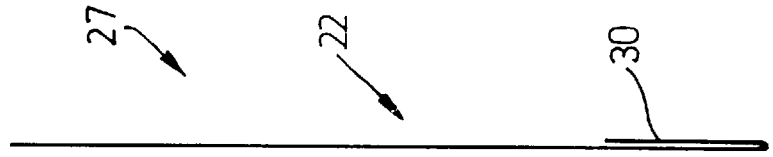
FIG. 9 shows a section through the material web according to FIG. 8.
Figure 8:
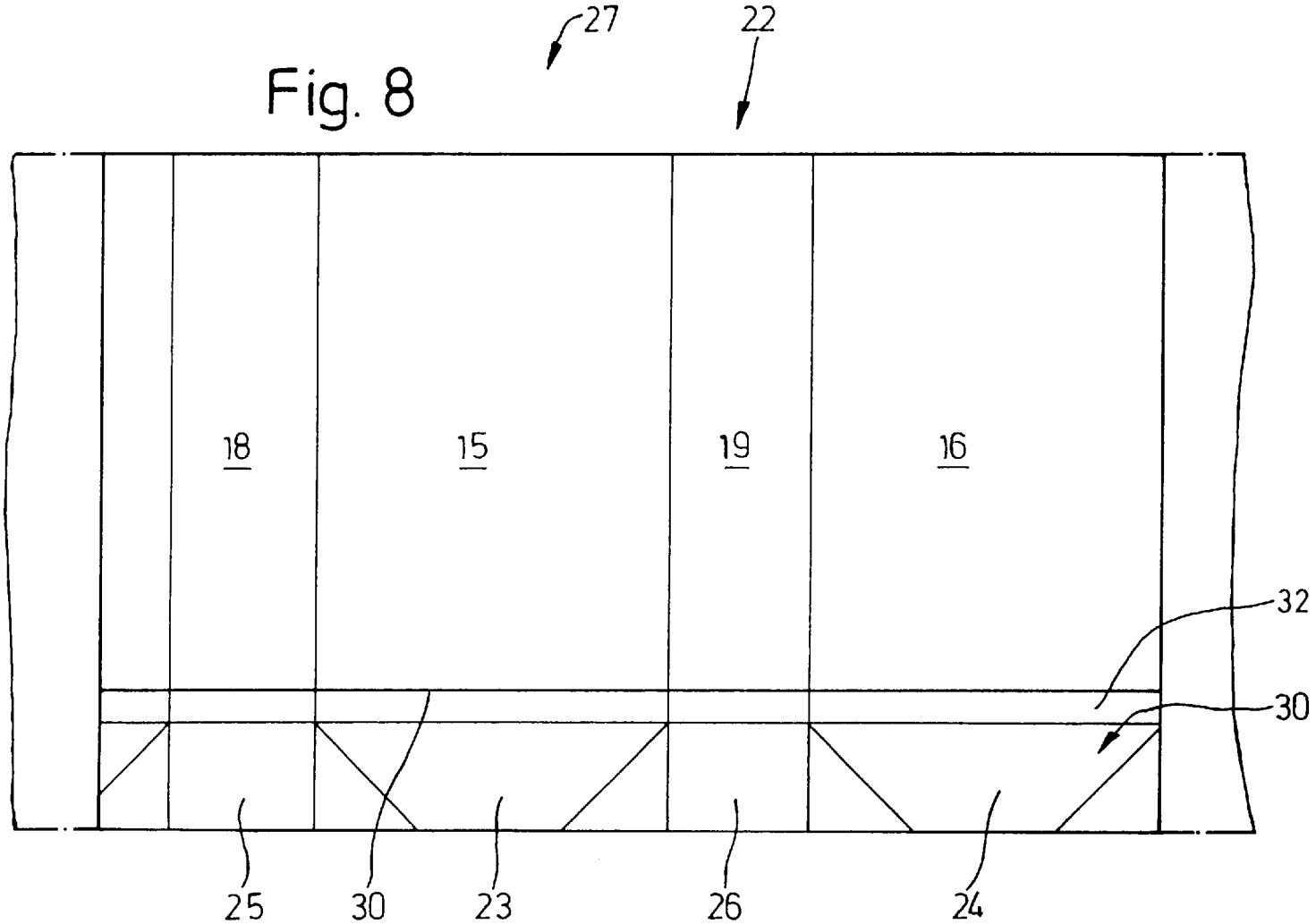
FIG. 8 shows a material web for the exemplary embodiment of FIGS. 4 and 5.
Figure 11:
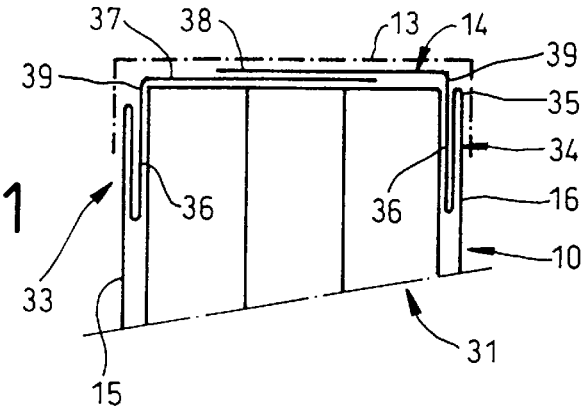
FIG. 11 shows the upper end region of the pack according to FIG. 10 on an enlarged scale.

In the exemplary embodiment according to FIGS. 6 and 7, the edge strip 29 corresponds in terms of width to a strip of the material web 27 for the production of the bottom wall 20. The exemplary embodiment according to FIGS. 8 and 9 relates to the production of cup blanks 21, 22 for a pack according to FIGS. 4 and 5. Here, the edge strip 30 has a larger width and extends into the region of the adjoining vertical pack walls, to form a reinforcing strip 32 in the region of these.

For a further increase in the dimensional stability of the pack in the region of the bottom wall, additionally or alternatively the inner blank 11 too can be made double-layer or multi-layer in the region of the bottom wall 20.

The exemplary embodiment according to FIG. 11 to FIG. 14 shows particulars of a modified soft-cup pack consisting of a single blank 17 of paper, foil or other thin packaging material. The bottom wall 20 of this pack is designed in the same way as that of the exemplary embodiment of FIG. 4 and FIG. 5. The edge strip 30 of the blank 17 is dimensioned in the region of the bottom wall 20 in such a way that reinforcing strips extend as edge regions of the edge strip 30 on the inside of the front wall 15, rear wall 16 and side walls 18, 19.

In this example, an upper end region of the blank 17 is likewise provided with a reinforcement 33 extending all-round. This is produced, here, by means of a multi-layer design of the blank 17, namely by means of a Z-shaped folding—Z-fold 34. The fold legs of the Z-fold 34 are located on the inside of the blank 17. An upper outer folding edge 35 extending all-round is thereby provided. Folding tabs 37, 38 located in the region of the end wall 14 adjoin an inner fold leg 36 of the Z-fold 34. The fold leg 34 projects slightly beyond the folding edge 35. This gives rise to an externally exposed visible strip 39 of the fold leg 36. The visible strip 39 and the adjoining folding tabs 37, 38 are moreover expediently contrasted from the blank 17 by colour or by different surface designs. In particular, the visible strip 39 and folding tabs 37, 38 can be of silver-coloured design, thus giving the impression that the cigarette group 31 is wrapped in a separate inner blank, as in the exemplary embodiments according to FIG. 1 to FIG. 9.

Figure 10:
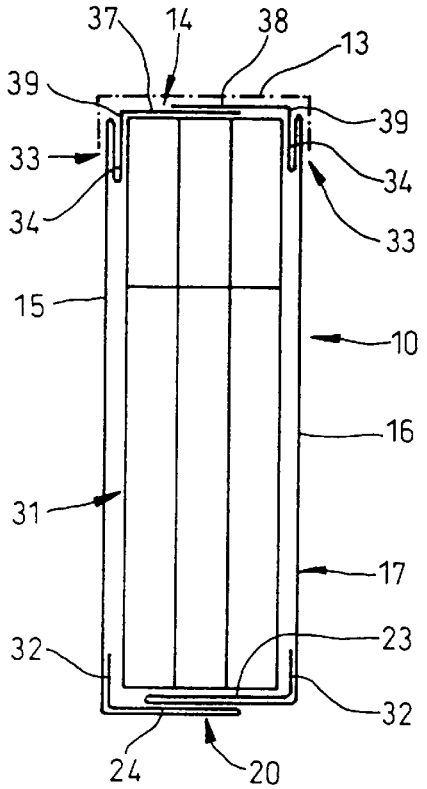
FIG. 10 shows a vertical section through a further embodiment of a soft pack.
Figure 12:
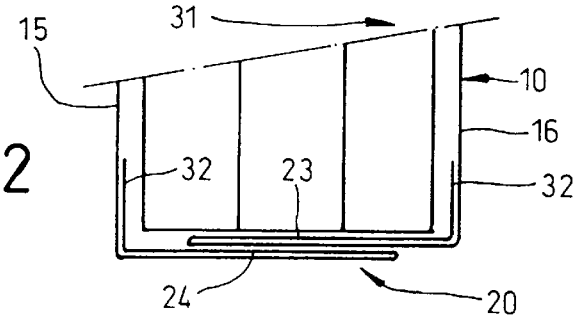
FIG. 12 shows a similar representation of the bottom region.
Figure 14:
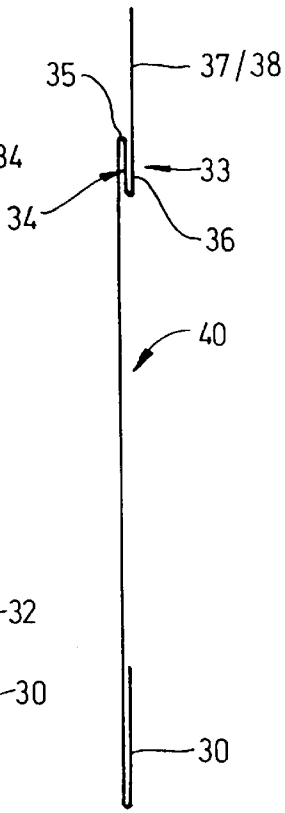
FIG. 14 shows a cross-section through the material web according to FIG. 13.
Figure 13:
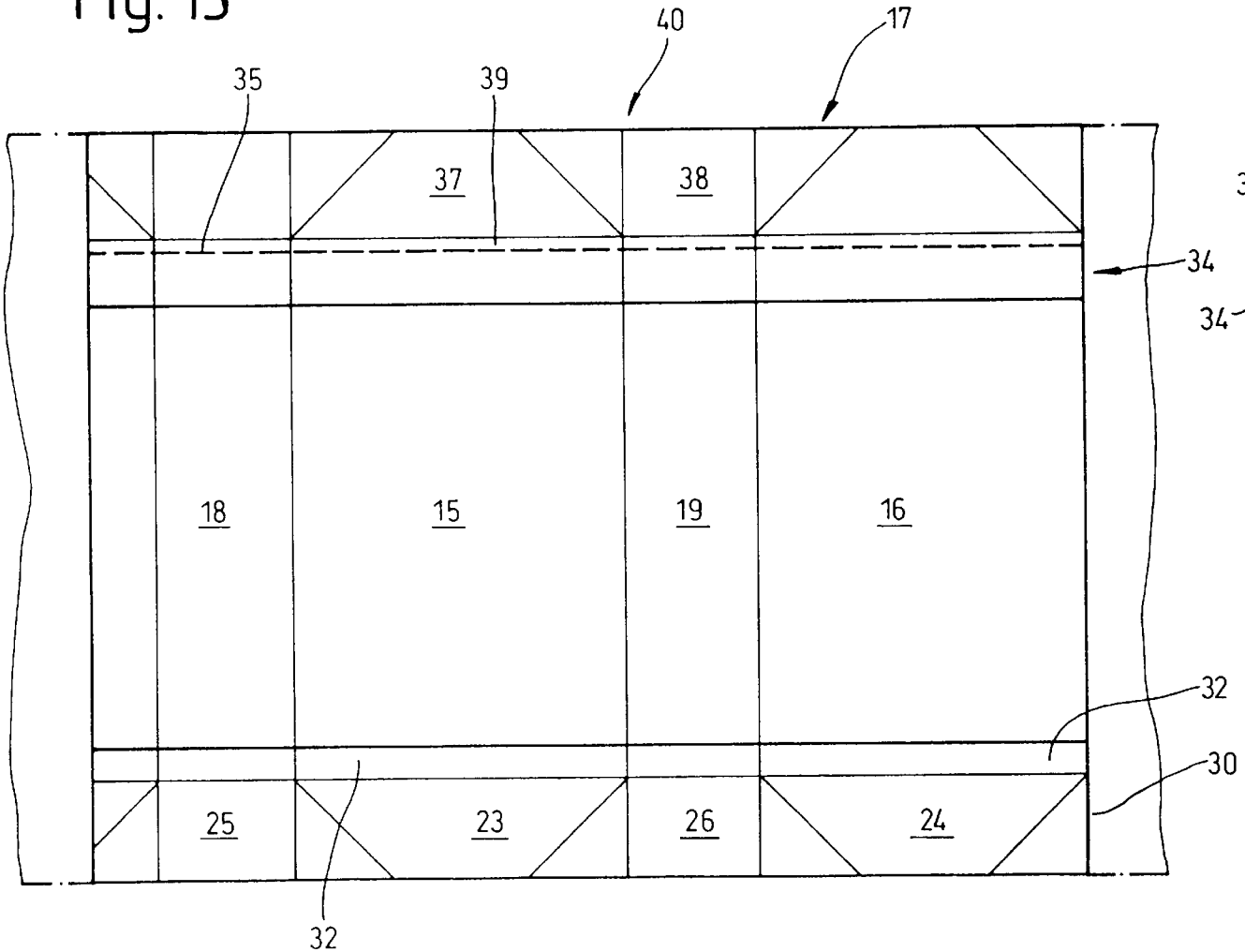
FIG. 13 shows a portion of a continuous material web for a pack according to FIG. 10.

A material web 40 for producing blanks 17 for packs according to FIG. 10 has two strip-shaped material reinforcements, namely folds, extending in the longitudinal direction of the material web 40. These are, on the one hand, the edge strip 30 and, on the other hand, the finished continuous Z-fold 34.

The design of the pack with a reinforcement at the upper end edge of the container 10, especially by means of a Z-fold 34, can also be employed in versions according to FIGS. 1 to 9, that is to say with an additional inner wrapping consisting of an inner blank

What is claimed is:

1. A soft-cup pack for a group (31) of cigarettes, and having a cup-shaped container (10) made from a blank (17) of foldable packaging material, wherein:

the pack has a bottom wall (20) which comprises a bottom edge strip of the blank which is folded over upon itself to form a double-walled bottom edge strip for the purpose of reinforcing the container (10);

said bottom edge strip includes bottom folding tabs each of which is double-walled; and the bottom wall (20) is formed by a plurality of partially overlapping ones of said double-walled bottom folding tabs.

2. The soft-cup pack according to claim 1, wherein the packaging material, and thus the blank, are made of single-ply paper.

3. The soft-cup pack according to claim 1, wherein said folded-over edge strip (29, 30) has a width less than or equal to that of said folding tabs.

4. The soft-cup pack according to claim 2, wherein said folded-over edge strip (29, 30) has a width less than or equal to that of said folding tabs.

5. The soft-cup pack according to claim 1, wherein said folded-over edge strip (29, 30) has a width which is greater than that of said folding tabs, and which extends into front (15), rear (16) and side (18, 19) walls of the container (10).

6. The soft-cup pack according to claim 2, wherein said folded-over edge strip (29, 30) has a width which is greater than that of said folding tabs, and which extends into front (15), rear (16) and side (18, 19) walls of the container (10).

7. The soft-cup pack according to claim 1, wherein the double walls of said bottom edge strip are bonded to each other.

8. The soft-cup pack according to claim 1, wherein:

the pack also has second double walls that are located in an upper region of the pack, facing a top wall (14) of the pack; and said second double walls are defined by a Z-fold (34) in an upper blank portion above said bottom edge strip of said blank.

9. The soft-cup pack according to claim 8, wherein the blank is a one-piece blank which includes said top wall (14), and wherein folding tabs (37, 38) of said top wall are connected in one-piece with an inner fold leg (36) of said Z-fold (34).

10. A cigarette soft pack having a container (10) for receiving a group (31) of cigarettes, said container (10) being made of a foldable paper blank having only a single-ply, wherein:

said pack has a reinforced bottom wall (20) which comprises a bottom edge strip of the blank which is folded over upon itself to form a double-walled bottom edge strip;

said edge strip includes folding tabs each of which is double-walled; and said bottom wall (20) is formed by a plurality of partially overlapping ones of said double-walled folding tabs.

* * * * *